US008995702B2

(12) United States Patent
Suzuki et al.

(10) Patent No.: US 8,995,702 B2
(45) Date of Patent: Mar. 31, 2015

(54) SPEAKER APPARATUS

(75) Inventors: Nobukazu Suzuki, Kanagawa (JP); Yoshio Ohashi, Kanagawa (JP); Teppei Yokota, Chiba (JP)

(73) Assignee: Sony Corporation, Tokyo (JP)

( * ) Notice: Subject to any disclaimer, the term of this patent is extended or adjusted under 35 U.S.C. 154(b) by 340 days.

(21) Appl. No.: 13/400,979

(22) Filed: Feb. 21, 2012

(65) Prior Publication Data

US 2012/0230499 A1 Sep. 13, 2012

(30) Foreign Application Priority Data

Mar. 7, 2011 (JP) ..... 2011-049027

(51) Int. Cl.

| | |
|---|---|
| ***H04R 1/02*** | (2006.01) |
| ***H04R 1/00*** | (2006.01) |
| ***H04R 11/06*** | (2006.01) |
| ***H04R 9/02*** | (2006.01) |

(52) U.S. Cl.

CPC ..... *H04R 1/025* (2013.01); *H04R 9/022* (2013.01); *H04R 1/028* (2013.01)

USPC ..... 381/394; 381/396; 381/397

(58) Field of Classification Search

USPC ..... 381/349, 394, 164, 396–397; 362/86

See application file for complete search history.

(56) References Cited

U.S. PATENT DOCUMENTS

| | | | | |
|---|---|---|---|---|
| 5,677,958 | A * | 10/1997 | Lehringer | 381/71.7 |
| 7,804,976 | B1 * | 9/2010 | Parham | 381/397 |
| 8,090,140 | B2 | 1/2012 | Suzuki et al. | |
| 2008/0298045 | A1 | 12/2008 | Wright | |
| 2009/0196016 | A1 | 8/2009 | Massara et al. | |
| 2010/0284555 | A1 | 11/2010 | Suzuki et al. | |
| 2010/0316247 | A1 * | 12/2010 | Ding | 381/397 |
| 2012/0106773 | A1 | 5/2012 | Suzuki et al. | |

FOREIGN PATENT DOCUMENTS

| | | |
|---|---|---|
| JP | 56-2698 U | 1/1981 |
| JP | 61-119488 U | 7/1986 |

OTHER PUBLICATIONS

Extended European Search Report issued Mar. 17, 2014 in Patent Application No. 12157119.4.

Japanese Office Action issued May 20, 2014, in Japan Patent Application No. 2011-049027 (with English translation).

* cited by examiner

*Primary Examiner* — Matthew Eason

(74) *Attorney, Agent, or Firm* — Oblon, McClelland, Maier & Neustadt, L.L.P.

(57) ABSTRACT

A speaker apparatus includes: a diaphragm vibrating to output sounds and being formed in an annular shape having a center hole in the middle thereof; a driving section causing the diaphragm to vibrate; a light emitting member emitting light; and a heat controlling member radiating heat generated when the light emitting member emits light or conducting the heat to a heat radiating section, wherein at least a part of the heat controlling member is provided on an axis including the center axis of the diaphragm, and the light emitting member is disposed on an end face of the heat controlling member.

12 Claims, 11 Drawing Sheets

SPEAKER APPARATUS

FIELD

The present disclosure relates to the field of techniques associated with speaker apparatus. More particularly, the present disclosure relates to the field of a technique for achieving improved sound quality while keeping a high level of heat radiation by disposing a light emitting member on an end face of a heat controlling member provided on an axis including a center axis of a diaphragm.

BACKGROUND

There are speaker apparatus which have a diaphragm and a driving section for vibrating the diaphragm and which output sounds as a result of the vibration of the diaphragm. For example, a magnetic circuit formed by a magnet, a yoke, and a voice coil may be used as such a driving section.

Such speaker apparatus include a type of speakers having a light or a light emitting member for emitting light at the same time when sounds are output (for example, see JP-A-2001-95074 (Patent Document 1) and JP-A-2010-57092 (Patent Document 2)).

For example, when a user of a speaker apparatus having a light reads a book, the apparatus can illuminate the book with light while outputting sounds as background music (BGM), which is very much user-friendly.

In speaker apparatus having a light disclosed in Patent Documents 1 and 2, a center hole is provided at the center of a yoke, and a holder holding a light emitting member such as a light emitting diode (LED) is inserted in the center hole of the yoke.

SUMMARY

When a light emitting member emits light, heat is generated as a result of the emission. The internal temperature of the speaker apparatus is likely to increase as a result of such heat generation, and such a temperature rise may adversely affect a driving section disposed in the speaker apparatus or make the light emitting state of the light emitting member unstable. In particular, when a light emitting diode is used as the light emitting member, a great amount of heat is generated when light is emitted, and it is therefore necessary to suppress a resultant temperature rise efficiently.

In the structure of the speaker apparatus disclosed in Patent Documents 1 and 2, no particular consideration is paid to efforts toward the suppression of a temperature rise such as radiating heat generated when a light emitting member emits light.

The quality of sounds output by such an apparatus may be degraded depending on the position where the light emitting member is disposed. For example, when the light emitting member and a holder for holding the light emitting member are located on a sound outputting side of the apparatus with respect to the diaphragm, the quality of sounds output by the apparatus can be degraded. It is therefore desirable to dispose the light emitting member and the holder in such positions that no degradation of sound quality will occur.

Thus, it is desirable to provide a speaker apparatus in which the above-described problem can be solved to achieve improved sound quality while keeping a high level of heat radiation.

An embodiment of the present disclosure is directed to a speaker apparatus including a diaphragm vibrating to output sounds and being formed in an annular shape having a center hole in the middle thereof, a driving section causing the diaphragm to vibrate, a light emitting member emitting light, and a heat controlling member radiating heat generated when the light emitting member emits light or conducting the heat to a heat radiating section. At least a part of the heat controlling member is provided on an axis including the center axis of the diaphragm. The light emitting member is disposed on an end face of the heat controlling member.

Heat generated in the speaker apparatus when the light emitting member emits light is radiated from the heat controlling member. Alternatively, the heat is conducted through the heat controlling member to the heat radiating section and radiated from the section.

The speaker apparatus preferably includes a heat radiating section radiating heat provided as the heat controlling member, and a part of the driving section is preferably used as the heat radiating section.

A heat radiating section for radiating heat is provided as the heat controlling member, and a part of the driving section is used as the heat radiating section. Thus, the driving section vibrates the diaphragm and radiates heat generated when the light emitting member emits light.

In the speaker apparatus, a space is preferably formed on an outer circumferential side of the part of the heat controlling member provided on an axis including the center axis of the diaphragm, and the space is preferably used as a bass reflex port for enhancing low pitched sounds.

A space is formed on an outer circumferential side of the part of the heat controlling member provided on an axis including the center axis of the diaphragm, and the space is used as a bass reflex port for enhancing low pitched sounds. Thus, a bass reflex port is formed on the heat controlling member for controlling heat generated when the light emitting member emits light.

The speaker apparatus preferably includes a connection cord for energizing the light emitting member, and the connection cord is preferably disposed in the bass reflex port.

A connection cord for energizing the light emitting member is provided, and the connection cord is disposed in the bass reflex port. Thus, the bass reflex port serves as a space for disposing the connection cord.

In the speaker apparatus, a heat sink is preferably used as the heat controlling member.

A heat sink is used as the heat controlling member, and heat generated when the light emitting member emits light is therefore radiated by the heat sink.

In the speaker apparatus, a plurality of heat radiating fins are preferably provided on the heat sink.

The plurality of heat radiating fins provided on the heat sink provide an increased heat radiating area.

The speaker apparatus preferably includes a heat pipe for conducting heat to the heat radiating section, provided as the heat controlling member.

A heat pipe conducting heat to the heat radiating section is provided as the heat controlling member. Thus, heat generated when the light emitting member emits light is conducted to the heat radiating section and radiated from the heat radiating section.

The speaker apparatus preferably includes a center cap having light transmitting or light diffusing properties disposed to cover the light emitting member.

The center cap having light transmitting or light diffusing properties is disposed to cover the light emitting member. Thus, the light emitting member is protected by the center cap.

The speaker apparatus according to the embodiment of the present disclosure includes the diaphragm vibrating to output sounds and being formed in an annular shape having a center hole in the middle thereof, the driving section causing the diaphragm to vibrate, the light emitting member emitting light, and the heat controlling member radiating heat generated when the light emitting member emits light or conducting the heat to a heat radiating section. At least a part of the heat controlling member is provided on an axis including the center axis of the diaphragm. The light emitting member is disposed on an end face of the heat controlling member.

Thus, heat generated when the light emitting member emits light is radiated by the heat controlling member to maintain satisfactory heat radiation. The light emitting member is provided on an axis including the center axis of the diaphragm and is disposed on an end face of the heat controlling member. Thus, the light emitting member is not in such a position that it can interfere with sounds, and high sound quality can therefore be achieved.

In one embodiment of the present disclosure, the speaker apparatus includes a heat radiating section radiating heat provided as the heat controlling member, and a part of the driving section is used as the heat radiating section.

It is therefore not required to provide a dedicated heat radiating section separately from the driving section. Thus, the speaker apparatus can be provided with a simple structure and a small size as a result of a reduction in the number of components.

In one embodiment of the present disclosure, a space is formed on an outer circumferential side of the part of the heat controlling member provided on an axis including the center axis of the diaphragm, and the space is used as a bass reflex port for enhancing low pitched sounds.

It is therefore possible to achieve a high level of heat radiation and enhancement of low pitched sounds with a simple configuration.

In one embodiment of the present disclosure, a connection cord for energizing the light emitting member is provided, and the connection cord is disposed in the bass reflex port.

There is no need for a dedicated space for disposing the connection cord, and the speaker apparatus can be made compact as a result of improved space utilization.

In one embodiment of the present disclosure, a heat sink is used as the heat controlling member.

Thus, high sound quality can be achieved while maintaining a high level of heat radiation.

In one embodiment of the present disclosure, a plurality of heat radiating fins are provided on the heat sink.

It is possible to obtain a greater heat radiating area, and a high level of heat radiation can therefore be achieved.

In one embodiment of the present disclosure, a heat pipe for conducting heat to the heat radiating section is provided as the heat controlling member.

Since the heat pipe allows heat to be conducted to a desired position, the speaker apparatus can be designed with a higher degree of freedom while achieving a high level of heat radiation.

In one embodiment of the present disclosure, the speaker apparatus includes a center cap having light transmitting or light diffusing properties disposed to cover the light emitting member.

Thus, the light emitting member is protected by the center cap, and the light-emitting state of the light emitting member can therefore be always kept satisfactory.

DETAILED DESCRIPTION

An embodiment of a speaker apparatus according to the present disclosure will now be described with reference to the accompanying drawings.

In the following description, upward, downward, frontward, rearward, leftward, and rightward directions with respect to a speaker apparatus are defined on an assumption that the direction toward which the speaker faces is a forward direction of the apparatus.

Upward, downward, frontward, rearward, leftward, and rightward directions as defined above will be used in the following direction for the sake of convenience, and the present disclosure is not limited to such directions.

[Schematic Configuration of Speaker Apparatus]

Figure 1:
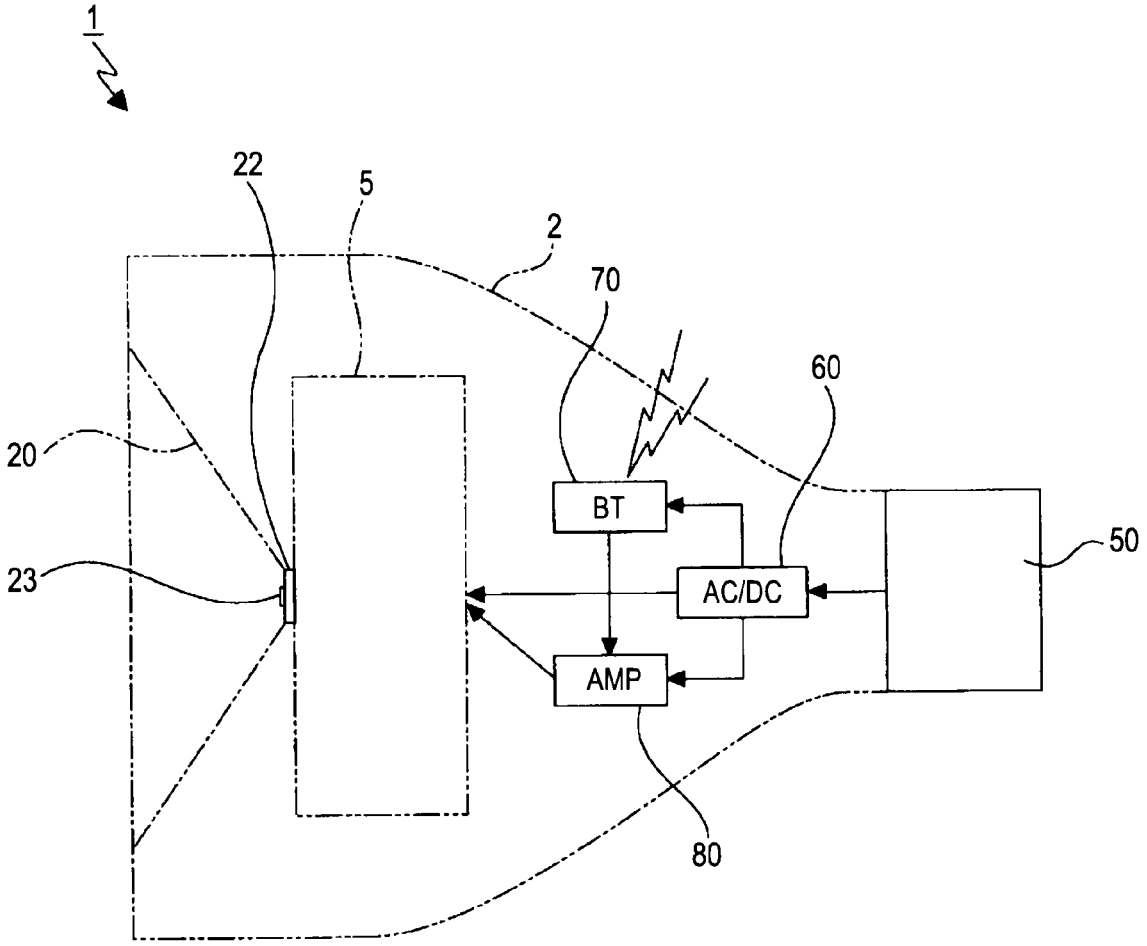
FIG. 1 is a conceptual diagram of an embodiment of a speaker apparatus according to the present disclosure, the diagram showing a configuration of the speaker apparatus.

A speaker apparatus 1 includes a power supply input section 50, a converter (AC/DC) 60, a receiving section (BT) 70, and an amplifier (AMP) 80 (see FIG. 1).

For example, the power supply input section 50 may be a base or a power supply connector connected at an end of a power supply cord.

The speaker apparatus 1 has a base which is provided as the power supply input section 50. The speaker apparatus 1 can be easily supplied with power by inserting the base into a power supply connector provided on a wall or ceiling. In addition, the base eliminates the need for a holding section for holding the speaker apparatus 1 on a wall or ceiling, and the speaker apparatus 1 can therefore be made compact.

The converter 60, the receiving section 70, and the amplifier 80 are provided on a circuit substrate which is not shown.

An AC current supplied from the power supply input section 50 is converted by the converter 60 into a DC current of a different voltage, and the DC current is input to the amplifier 80.

For example, Bluetooth is used as a communication standard for the receiving section 70, and audio data can be input to the receiving section 70 using a personal computer or mobile phone. Audio data input to the receiving section 70 are amplified by the amplifier 80 and output from the speaker apparatus 1 as sounds.

[Specific Configuration of Speaker Apparatus]

Figure 2:
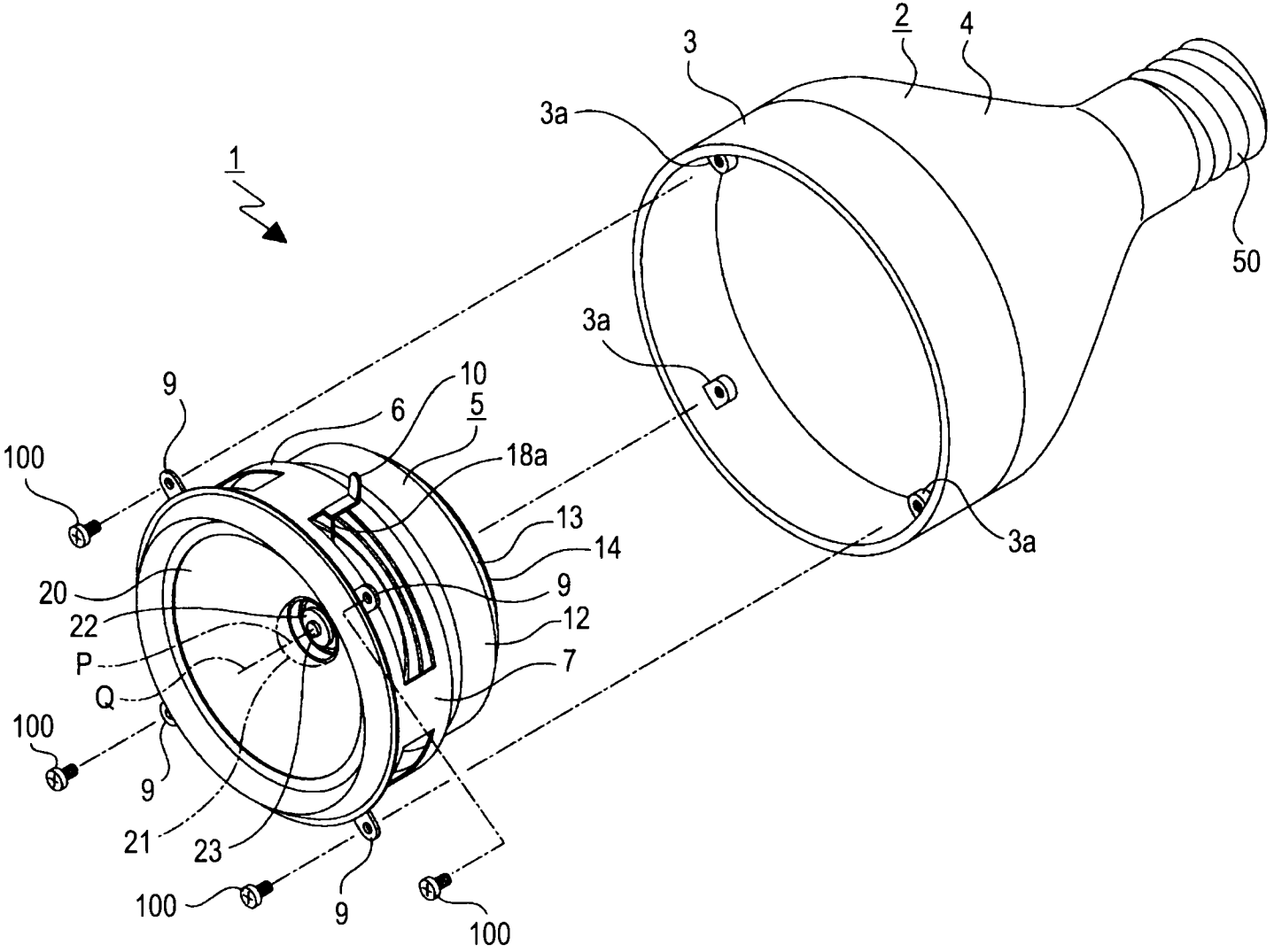
FIG. 2 is a schematic exploded perspective view of the speaker apparatus.
Figure 3:
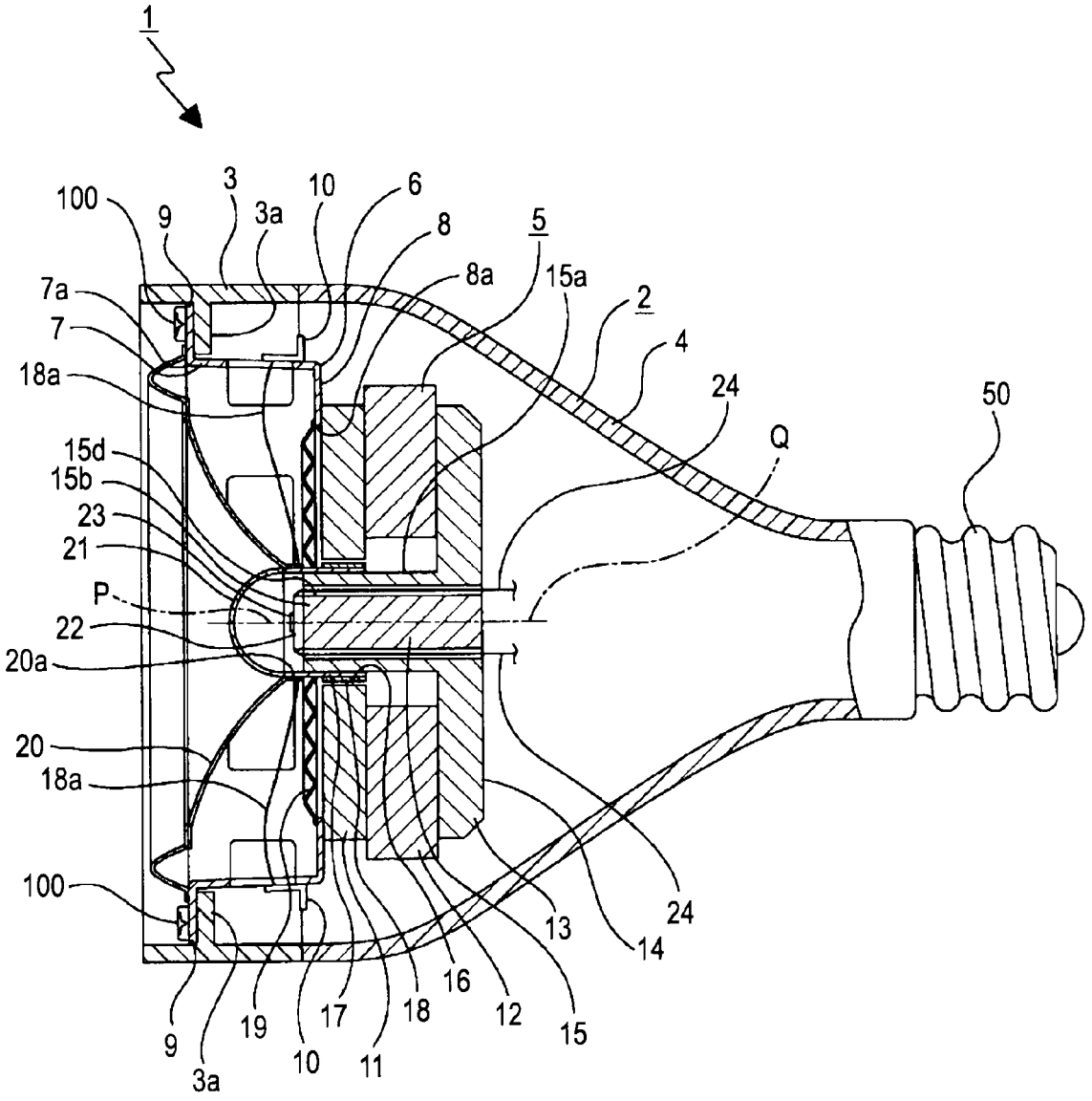
FIG. 3 is a schematic sectional view of the speaker apparatus.

The speaker apparatus 1 has a housing 2 (see FIGS. 2 and 3). The housing 2 is formed by an annular retention ring 3 and a cylindrical section 4 mounted on a rear surface of the retention ring 3.

The retention ring 3 has mounting projections 3*a* projecting inwardly from an inner circumferential surface thereof and spaced each other in the circumferential direction of the ring.

The cylindrical section 4 is formed in such a shape that the diameter of the section tapers rearward. A base to serve as the power supply input section 50 is mounted on the rear end of the cylindrical section 4.

A speaker unit 5 is disposed inside the housing 2 and at the front end thereof. The speaker unit 5 is formed by mounting required parts on a frame 6 which serves as amounting plate.

The frame 6 is formed by a cylindrical base portion 7 whose axis extends in the front-rear direction of the apparatus, a bottom portion 8 inwardly extending from a rear edge of the base portion 7, and female mounting projections 9 outwardly projecting from a front edge of the base portion 7. The female mounting projections 9 are spaced from each other in the circumferential direction of the base portion.

The base portion 7 has an opening 7*a* facing frontward or facing in the direction in which sounds are output.

Connecting pieces 10 are mounted on an outer circumferential surface of the base portion 7 in such positions that the mounting pieces are spaced at 180° from each other in the circumferential direction of the base portion.

The bottom portion 8 has a center hole which is formed as an insertion hole 8*a*.

The female mounting projections 9 on the frame 6 of the speaker unit 5 is mounted to the mounting projections 3*a* on the housing 2 using mounting screws 100.

An annular plate 11 is attached to a rear surface of the base portion 7. An annular magnet 12 is attached to a rear surface of the plate 11. The plate 11 and the magnet 12 are combined with their center axes coinciding with each other.

A yoke 13 formed from a magnetic metal material is attached to a rear surface of the magnet 12. The yoke 13 has a substantially disk-shaped base plane portion 14 and an inserted portion 15 projecting frontward from a central part of the base plane portion 14, those portions being formed integrally with each other.

Figure 4:
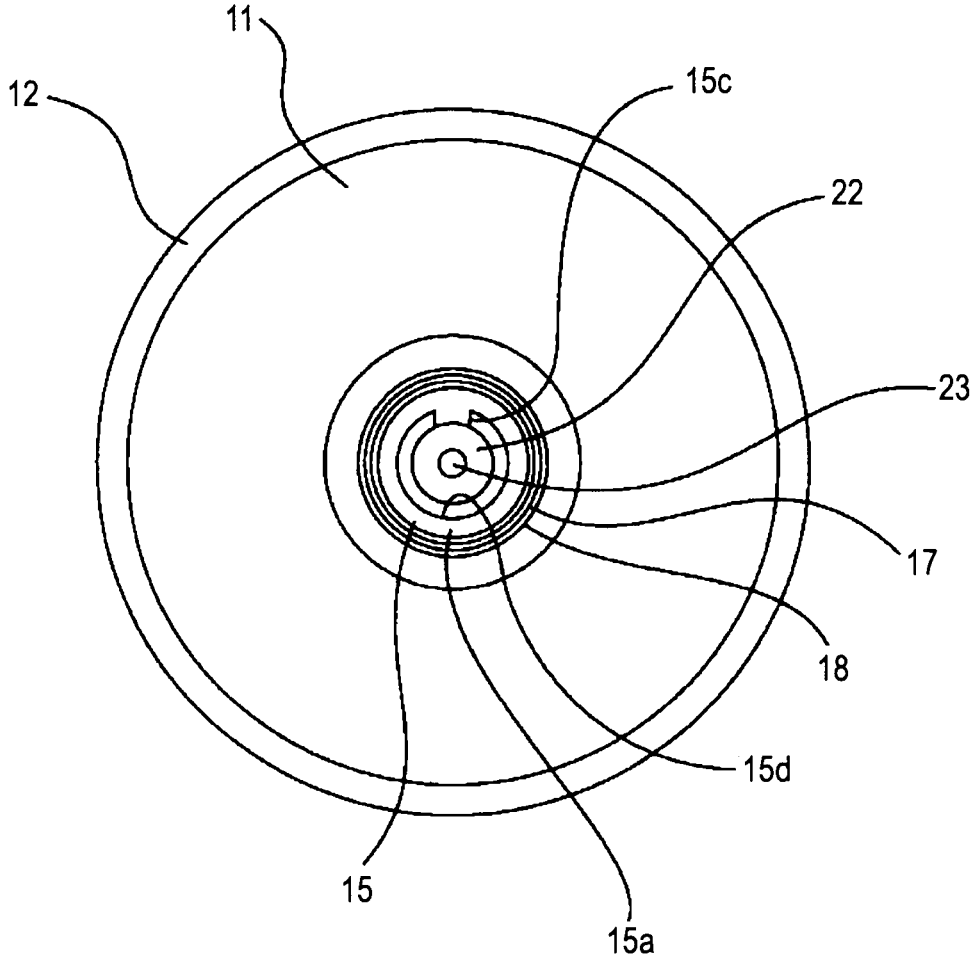
FIG. 4 is a front view of a magnetic circuit shown with a substrate mounted in place.

As shown in FIGS. 3 and 4, the inserted portion 15 is formed by a cylindrical peripheral part 15*a*, a cylindrical pole part 15*b* located inside the peripheral part 15*a*, and a connecting part 15*c* connecting a part of an inner circumferential surface of the peripheral part 15*a* and a part of an outer circumferential surface of the pole part 15*b*.

A space is defined in the inserted portion 15 so as to extend in the front-rear direction of the inserted portion 15 between the outer peripheral part 15*a* and the pole part 15*b*, and this space is formed as a bass reflex port 15*d* for enhancing low-pitched sounds.

The yoke 13 is disposed by attaching a front surface of the base plane portion 14 to a rear surface of the magnet 12 and inserting the inserted portion 15 through the center hole of the magnet 12, the center hole of the plate 11, and the insertion hole 8*a* of the frame 6 from the rear sides thereof. When the inserted portion 15 is inserted through the center holes of the magnet 11 and the plate 11, the leading end face of the inserted portion 15 is located slightly frontward with respect to the plate 11, and the pole part 15*b* of the inserted portion 15 is aligned with the center axes of the plate 11 and the magnet 12.

The space defined between the inserted portion 15 of the yoke 13 and the plate 11 and the magnet 12 constitutes a magnetic gap 16.

A cylindrical coil bobbin 17 is disposed in the frame 6, and the coil bobbin 17 is fitted or supported on the inserted portion 15 externally of the inserted portion 15 excluding a front end part thereof. The coil bobbin 17 is movable with respect to the inserted portion 15 in the axial direction (front-rear direction) of the apparatus.

A voice coil 18 is wound around an outer circumferential surface of a rear end part of the coil bobbin 17. Two ends 18*a* of the voice coil 18 are led out from the wound part of the coil and are connected to respective connecting pieces 10. The voice coil 18 is disposed in the magnetic gap 16 excluding the ends 18*a*.

Since the voice coil 18 is disposed in the magnetic gap 16, a magnetic circuit to serve as a driving section for vibrating a diaphragm to be described later is formed by the magnet 12, the yoke 13, and the voice coil 18.

A damper 19 is attached to an intermediate part of the coil bobbin 17 when viewed in the axial direction. The damper 19 is formed in a thin and substantially annular shape and is elastically deformable. An inner circumferential part of the damper 19 is attached to an outer circumferential surface of the coil bobbin 17, and an outer circumferential part of the damper 19 is attached to the bottom portion 8 of the frame 6. When a driving current is supplied to the voice coil 18 to move the coil bobbin 17 in the axial direction, the damper 19 is elastically deformed to suppress excessive movement of the coil bobbin 17 in the axial direction thereof.

A diaphragm 20 is attached to a front end of the coil bobbin 17. The diaphragm 20 is formed in an annular shape, and it has a center hole 20*a* in the middle thereof. The diaphragm 20 is sloped such that its diameter is inversely tapered toward the front end thereof. A center axis P of the diaphragm 20 coincides with the center axes of the plate 11 and the magnet 12.

An inner circumferential part of the diaphragm 20 is attached to the front end of the coil bobbin 17, and an outer circumferential part of the diaphragm 20 is attached to a front end of the frame 6. Therefore, the diaphragm 20 vibrates about the front end of the coil bobbin 17 serving as a supporting point as the coil bobbin 17 moves in the axial direction thereof.

A semispherical center cap 21 is attached to the front end of the coil bobbin 17. The center cap 21 is formed from a transparent resin material or glass material.

The speaker apparatus 1 may be configured without the center cap 21. When the center cap 21 is attached, in order to allow the space defined in the inserted portion 15 and extending in the front-rear direction to effectively function as the bass reflex port 15*d*, the housing 2 must be formed with a heat radiation hole (not shown) for venting out air which has been warmed in the housing 2.

A substrate 22 is attached to a front surface of the pole part 15*b* of the inserted portion 15 of the yoke 13. The substrate 22 is attached to the pole part 15*b* using a material reducing thermal contact resistance and having high thermal conductivity, e.g., thermal grease, a high thermal conductivity adhesive, or a thermal tape.

For example, a light emitting diode (LED) as a light emitting member 23 is mounted on the front surface of the substrate 22. The present disclosure is not limited to the use of a light emitting diode as the light emitting member 23. For example, an organic EL (Electro-Luminescence) element may alternatively be used. The light emitting member 23 is disposed on an axis Q which includes the center axis P of the diaphragm 20.

Connection cords 24 for energizing the light emitting member 23 are connected to the substrate 22, and the connection cords 24 are connected to a power supply circuit on the circuit substrate disposed in the housing 2 via the bass reflex port 15*b*.

[Operations of Speaker Apparatus]

When a driving current is supplied to the voice coil 18 of the speaker apparatus 1 having a configuration as described above, a thrust is generated at the magnetic circuit (driving section) to move the coil bobbin 17 in the front-rear direction (axial direction), and the diaphragm 20 vibrates as a result of the movement of the coil bobbin 17. Then, sounds amplified by the amplifier 80 are output.

Light can be emitted frontward from the light emitting member 23 as illuminating light whether sounds are output or not. When light is emitted from the light emitting member 23, heat is generated at the light emitting member 23 and the substrate 22, and the heat generated is conducted from the inserted portion 15 of the yoke 13 to the base plane portion 14 and radiated from the base plane portion 14.

Therefore, the yoke 13 serves as a heat radiating section (heat radiating structure) or a heat controlling member for radiating heat generated when the light emitting member 23 emits light.

For example, when a heat radiation hole is formed in a part of the housing 2, heat radiated from the base plane portion 14 is radiated out of the speaker apparatus 1 through the heat radiation hole.

For example, when a part of the housing 2 is formed as a heat radiating section from a material having high heat radiating properties such as a metal material, heat generated in the apparatus may be conducted from the base plane portion 14 to the heat radiating section to radiate the heat out of the apparatus. The conduction of heat from the base plane portion 14 to the heat radiating section, the conduction may be achieved by connecting the base plane portion 14 and the heat radiating section using a heat conduction member such as a heat pipe or putting a part of the base plane portion 14 in contact with the heat radiating section.

[Conclusion]

As described above, the speaker apparatus 1 includes the diaphragm 20 vibrating to output sounds, the driving section (magnetic circuit) vibrating the diaphragm 20, the light emitting member 23 emitting light, and the yoke 13 serving as a heat controlling member for radiating heat generated when the light emitting member 23 emits light. The inserted portion 15 of the yoke 13 is provided on the axis Q including the center axis P of the diaphragm 20, and the light emitting member 23 is disposed at a leading end face of the inserted portion 15.

The yoke 13 radiates heat generated when the light emitting member 23 emits light to achieve satisfactory heat radiation. Further, the light emitting member 23 is disposed on the leading end face of the inserted portion 15 provided on the axis Q including the center axis P of the diaphragm 20. The light emitting member 23 is not disposed in a location where it can interfere with sounds, and improved sound quality can therefore be achieved.

The yoke 13 to serve as a driving section (magnetic circuit) for vibrating the diaphragm 20 is provided as a heat radiating section. It is therefore not necessary to provide a dedicated heat radiating section separately, and the speaker 1 can be provided with a simple and compact structure as a result of a reduction in the number of components.

Further, since the inserted portion 15 of the yoke 13 is formed with the bass reflex port 15*d* for enhancing low-pitched sounds, improved heat radiation and enhancement of low-pitched sounds can be achieved by a simple configuration.

Furthermore, since the connection cords 24 for energizing the light emitting member 23 are disposed in the bass reflex port 15*d*, there is no need for a space used for accommodating the connection cords 24 only, and the speaker apparatus 1 can therefore provided with a small size as a result of improved space utilization.

In addition, the center cap 21 having light transmitting properties or light diffusing properties is disposed to cover the light emitting member 23. Thus, the light emitting member 23 is protected by the center cap 23, and the light emitting member 23 can be always kept in a satisfactory light emitting state.

<Modifications of Heat Radiating Structure>

Modifications of the heat radiating structure for radiating heat generated when the light emitting member 23 emits light will now be described (see FIGS. 5 to 11).

The modified heat radiating structures described below are different from the above-described heat radiating structure only in the structure of the yoke or only in that a separate heat controlling member is attached to the yoke. Therefore, the following description of the heat radiating structures will address only differences from the heat radiating structure of the speaker apparatus 1 in detail. Other features which are similar between the modifications and the above-described heat radiating structure are indicated by the same reference numerals as used above, and the description of such features will be omitted in the following.

[First Modification]

Figure 5:
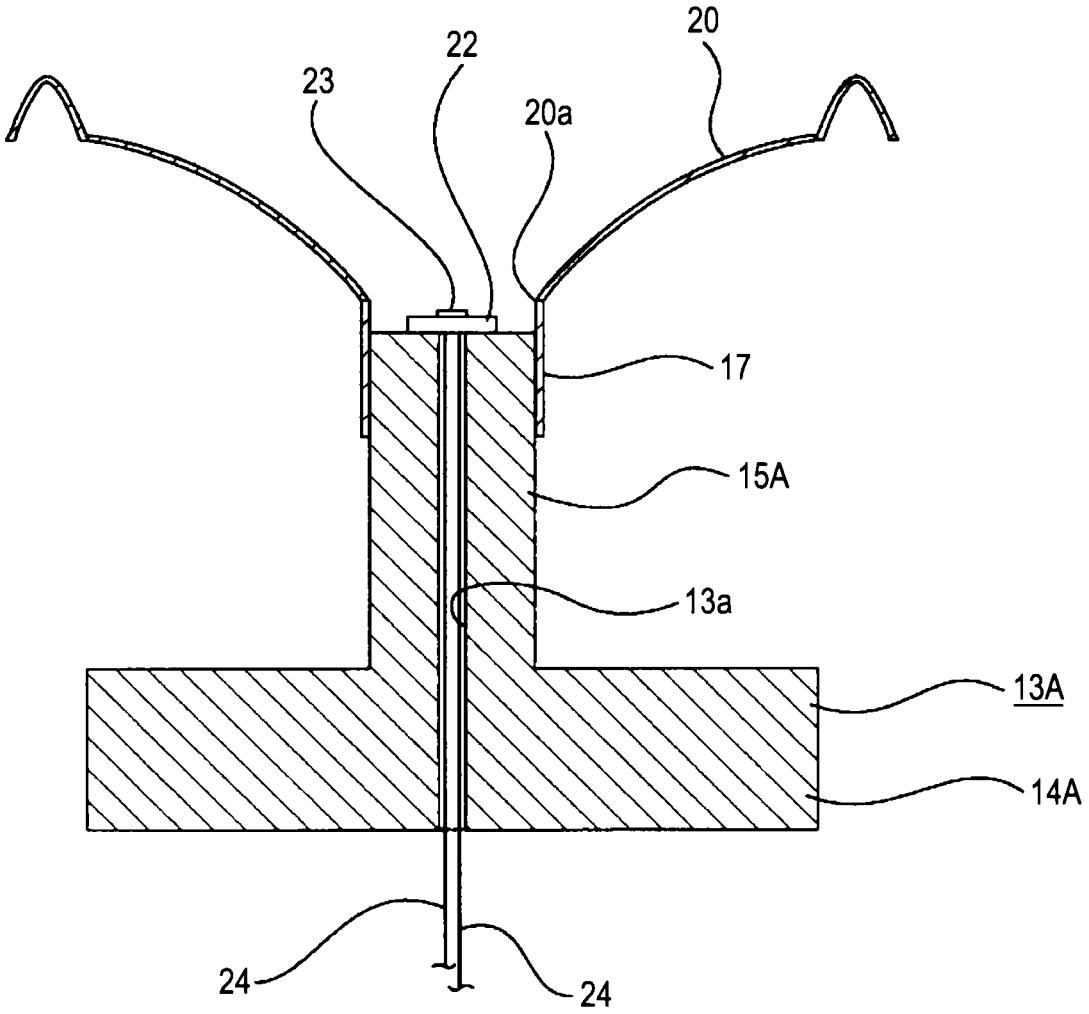
FIG. 5 is a schematic sectional view of a heat radiating structure according to a first modification of the embodiment.

A heat radiating structure according to a first modification of the embodiment will now be described (see FIG. 5). The heat radiating structure according to the first modification includes a yoke 13A.

The yoke 13A is attached to a rear surface of a magnet 12. The yoke 13A has a substantially disk-shaped base plane portion 14A and an inserted portion 15A projecting frontward from a central part of the base plane portion 14A, those portions being formed integrally with each other.

The yoke 13A is formed with cord accommodating holes 13*a* penetrating through central parts of the inserted portion 15A and the base plane portion 14A in the front-rear direction of the apparatus.

A substrate 22 is attached to a front surface of the inserted portion 15A.

Connection cords 24 for energizing a light emitting member 23 are connected to the substrate 22, and the connection cords 24 are laid through the cord accommodating holes 13*a* and connected to a power supply circuit on the circuit substrate which is disposed in a housing 2.

Heat generated when the light emitting member 23 emits light is conducted from the inserted portion 15A of the yoke 13A to the base plane portion 14A and radiated from the base plane portion 14A.

Therefore, the yoke 13A serves an a heat radiating section or a heat controlling member for radiating heat generated when the light emitting member 23 emits light.

Since the cord accommodating holes 13*a* for accommodating the connection cords 24 are formed in the yoke 13A as described above, there is no need for providing a dedicated space for accommodating the connection cords 24 outside the magnetic circuit, and the speaker apparatus 1 can be provided with a small size as a result of improved space utilization.

In the heat radiating structure according to the first modification, the cord accommodating holes 13*a* may be filled after the connection cords 24 are disposed in the holes 13*a*.

[Second Modification]

Figure 6:
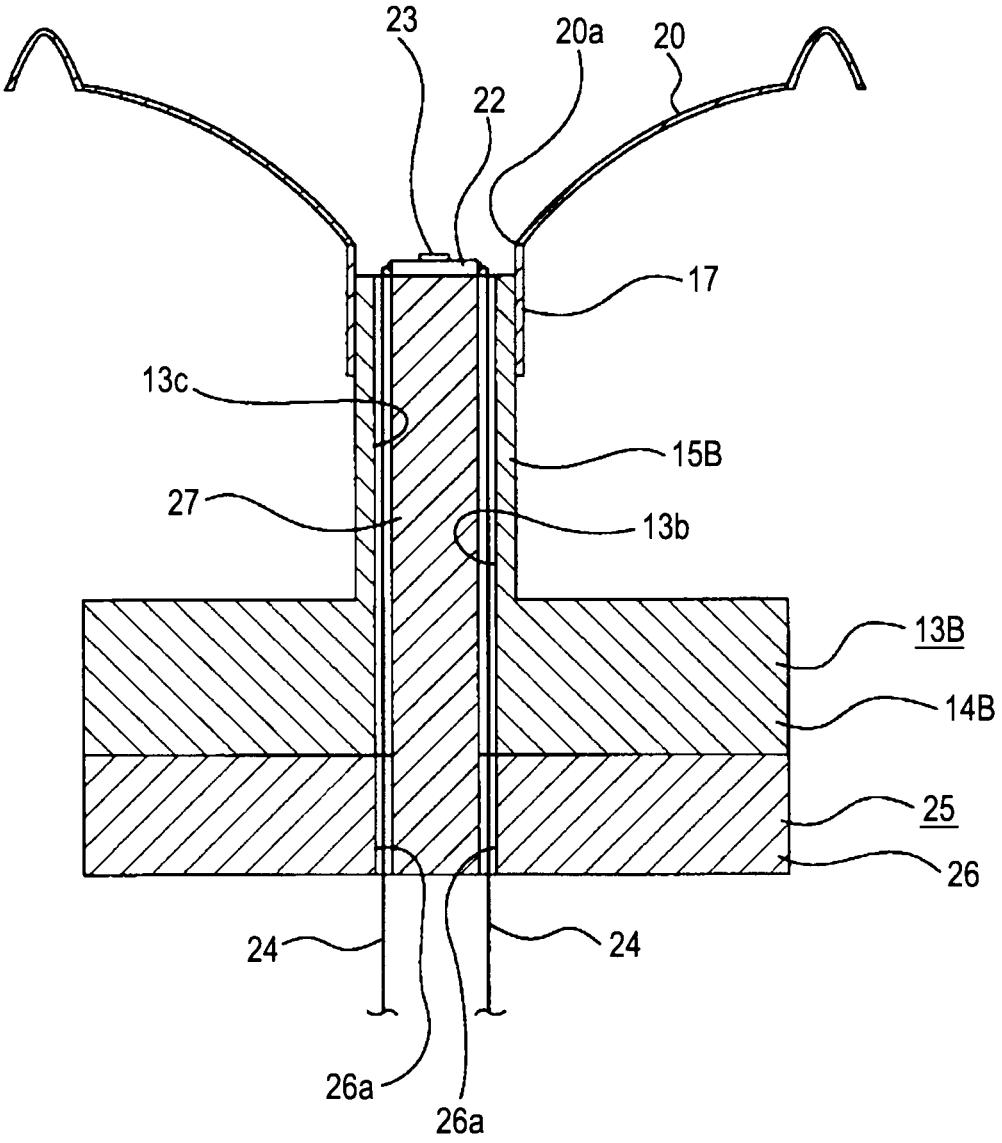
FIG. 6 is a schematic sectional view of a heat radiating structure according to a second modification of the embodiment.
Figure 7:
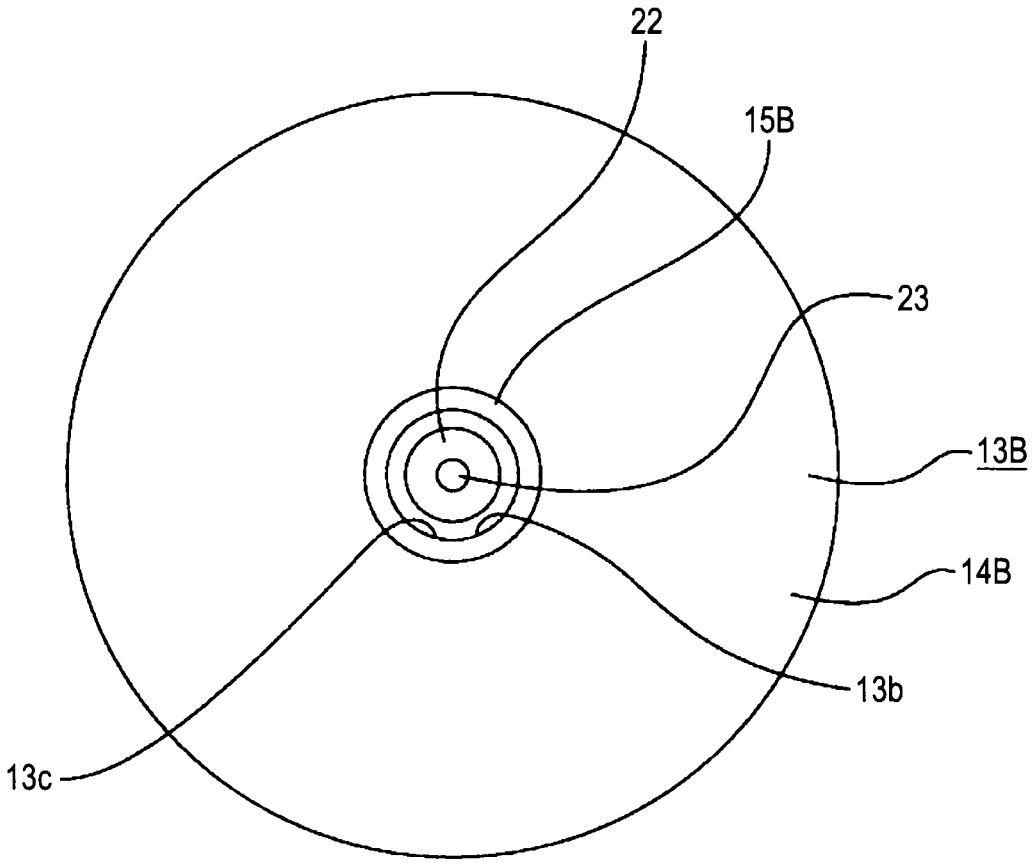
FIG. 7 is a schematic front view of the heat radiating structure according to the second modification of the embodiment.

A heat radiating structure according to a second modification of the embodiment will now be described (see FIGS. 6 and 7). The heat radiating structure according to the second modification includes a yoke 13B and a heat sink 25.

The yoke 13B is attached to a rear surface of a magnet 12. The yoke 13B has a substantially disk-shaped base plane portion 14B and an inserted portion 15B projecting frontward from a central part of the base plane portion 14B, those portions being formed integrally with each other.

The yoke 13B is formed with a shaft accommodating hole 13*b* penetrating through central parts of the inserted portion 15B and the base plane portion 14B in the front-rear direction of the apparatus.

A heat sink 25 formed from a material having high thermal conductivity is attached to a rear surface of the yoke 13B. The heat sink 25 has a substantially disk-shaped base portion 26 and an inserted shaft portion 27 projecting frontward from a central part of the base portion 26, those portions being formed integrally with each other. The base portion 26 is formed with insertion holes 26*a* which penetrate through the base portion 26 in the front-rear direction in positions near the center of the base portion 26.

The inserted shaft portion 27 of the heat sink 25 has a diameter smaller than the diameter of the shaft accommodating hole 13*b*. A front surface of the base portion 26 of the heat sink 25 is attached to a rear surface of the base plane portion 14B, and the inserted shaft portion 27 is inserted in the shaft accommodating hole 13*b* from the rear side thereof.

When the inserted shaft portion 27 is inserted in the shaft accommodating hole 13*b*, a cord accommodating space 13*c* is formed outside the inserted shaft portion 27, and the insertion holes 26*a* formed in the base portion 26 are in communication with the cord accommodating space 13*c*.

A substrate 22 is attached to a front surface of the inserted shaft portion 27 of the heat sink 25.

Connection cords 24 for energizing a light emitting member 23 are connected to the substrate 22, and the connection cords 24 are laid through the cord accommodating space 13*c* and the insertion holes 26*a* and connected to a power supply circuit on the circuit substrate which is disposed in a housing 2.

Heat generated when the light emitting member 23 emits light is conducted from the inserted shaft portion 27 of the heat sink 25 to the base portion 26 and radiated from the base portion 26.

Therefore, the heat sink 25 serves as a heat radiating section or a heat controlling member for radiating heat generated when the light emitting member 23 emits light.

Since heat generated when the light emitting member 23 emits light is radiated using the heat sink 25, improved sound quality can be achieved while maintaining a high level of heat radiation.

The cord accommodating space 13*c* and the insertion holes 26*a* for accommodating the connection cords 24 are formed in the yoke 13B and the heat sink 25, respectively. It is therefore not necessary to provide dedicated spaces for accommodating the connection cords 24 outside the magnetic circuit, and the speaker apparatus 1 can be provided in a small size as a result of improved space utilization.

In the heat radiating structure of the second modification, the cord accommodating space 13*c* and the insertion holes 26*a* can be used as a bass reflex port.

In the heat radiating structure of the second modification, the cord accommodating space 13*c* and the insertion holes 26*a* may be filled after the connection cords 24 are disposed in the cord accommodating space 13*c* and the insertion holes 26*a* in the same way as in the heat radiating structure according to the first modification.

[Third Modification]

Figure 8:
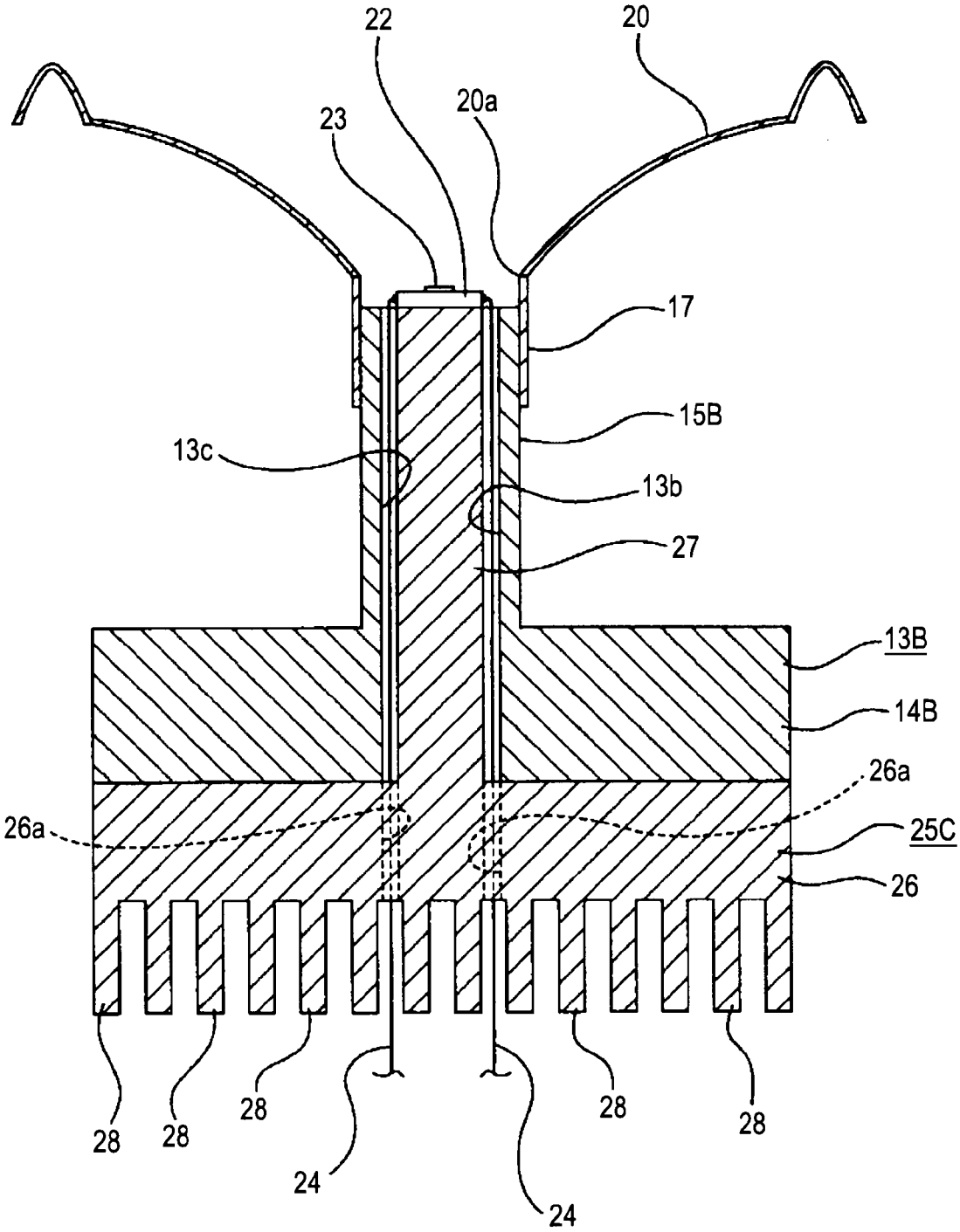
FIG. 8 is a schematic sectional view of a heat radiating structure according to a third modification of the embodiment.

A heat radiating structure according to a third modification of the embodiment will now be described (see FIG. 8). The heat radiating structure according to the third modification includes a yoke 13B and a heat sink 25C.

The yoke 13B is attached to a rear surface of a magnet 12. The yoke 13B has a substantially disk-shaped base plane portion 14B and an inserted portion 15B projecting frontward from a central part of the base plane portion 14B, those portions being formed integrally with each other.

The yoke 13B is formed with a shaft accommodating hole 13*b* penetrating through central parts of the inserted portion 15B and the base plane portion 14B in the front-rear direction of the apparatus.

A heat sink 25C formed from a material having high thermal conductivity is attached to a rear surface of the yoke 13B. The heat sink 250 has a substantially disk-shaped base portion 26, an inserted shaft portion 27 projecting frontward from a central part of the base portion 26, and a plurality of heat radiating fins 28 projecting rearward from the inserted shaft portion 27, those portions being formed integrally with each other. The base portion 26 is formed with insertion holes 26*a* which penetrate through the base portion 26 in the front-rear direction.

The inserted shaft portion 27 of the heat sink 25C has a diameter smaller than the diameter of the shaft accommodating hole 13*b*. A front surface of the base portion 26 of the heat sink 25C is attached to a rear surface of the base plane portion 14B, and the inserted shaft portion 27 is inserted in the shaft accommodating hole 13*b* from the rear side thereof.

When the inserted shaft portion 27 is inserted in the shaft accommodating hole 13*b*, a cord accommodating space 13*c* is formed outside the inserted shaft portion 27, and the insertion holes 26*a* formed in the base portion 26 are in communication with the cord accommodating space 13*c*.

A substrate 22 is attached to a front surface of the inserted shaft portion 27 of the heat sink 25C.

Connection cords 24 for energizing a light emitting member 23 are connected to the substrate 22, and the connection cords 24 are laid through the cord accommodating space 13*c* and the insertion holes 26*a* and connected to a power supply circuit on the circuit substrate which is disposed in a housing 2.

Heat generated when the light emitting member 23 emits light is conducted from the inserted shaft portion 27 and the base portion 26 of the heat sink 25C to the heat radiating fins 28 and radiated from the heat radiating fins 28.

Therefore, the heat sink 25C serves as a heat radiating section or a heat controlling member for radiating heat generated when the light emitting member 23 emits light.

Since heat generated when the light emitting member 23 emits light is radiated using the heat sink 25C as described above, improved sound quality can be achieved while maintaining a high level of heat radiation.

The heat radiating fins 28 disposed on the heat sink 25C provide a greater heat radiating area, whereby a high level of heat radiation can be maintained.

The cord accommodating space 13*c* and the insertion holes 26*a* for accommodating the connection cords 24 are formed in the yoke 13B and the heat sink 25C, respectively. It is therefore not necessary to provide dedicated spaces for accommodating the connection cords 24 outside the magnetic circuit, and the speaker apparatus 1 can be provided in a small size as a result of improved space utilization.

In the heat radiating structure of the third modification, the cord accommodating space 13*c* and the insertion holes 26*a* can be used as a bass reflex port just as done in the heat radiating structure of the second modification.

In the heat radiating structure of the third modification, the cord accommodating space 13*c* and the insertion holes 26*a* may be filled after the connection cords 24 are disposed in the cord accommodating space 13*c* and the insertion holes 26*a* in the same way as in the heat radiating structures according to the first modification and the second modification.

[Fourth Modification]

Figure 9:
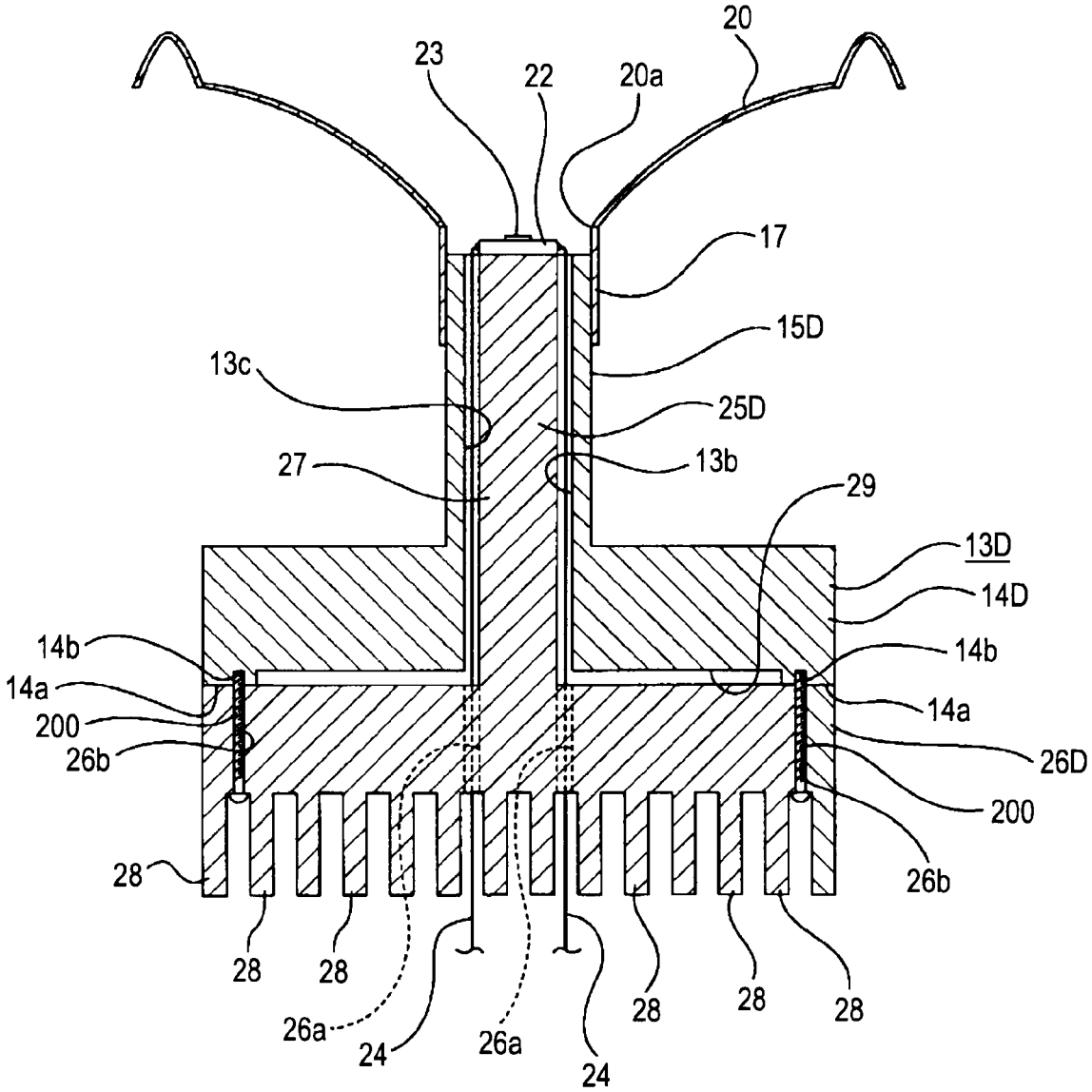
FIG. 9 is a schematic sectional view of a heat radiating structure according to a fourth modification of the embodiment.
Figure 10:
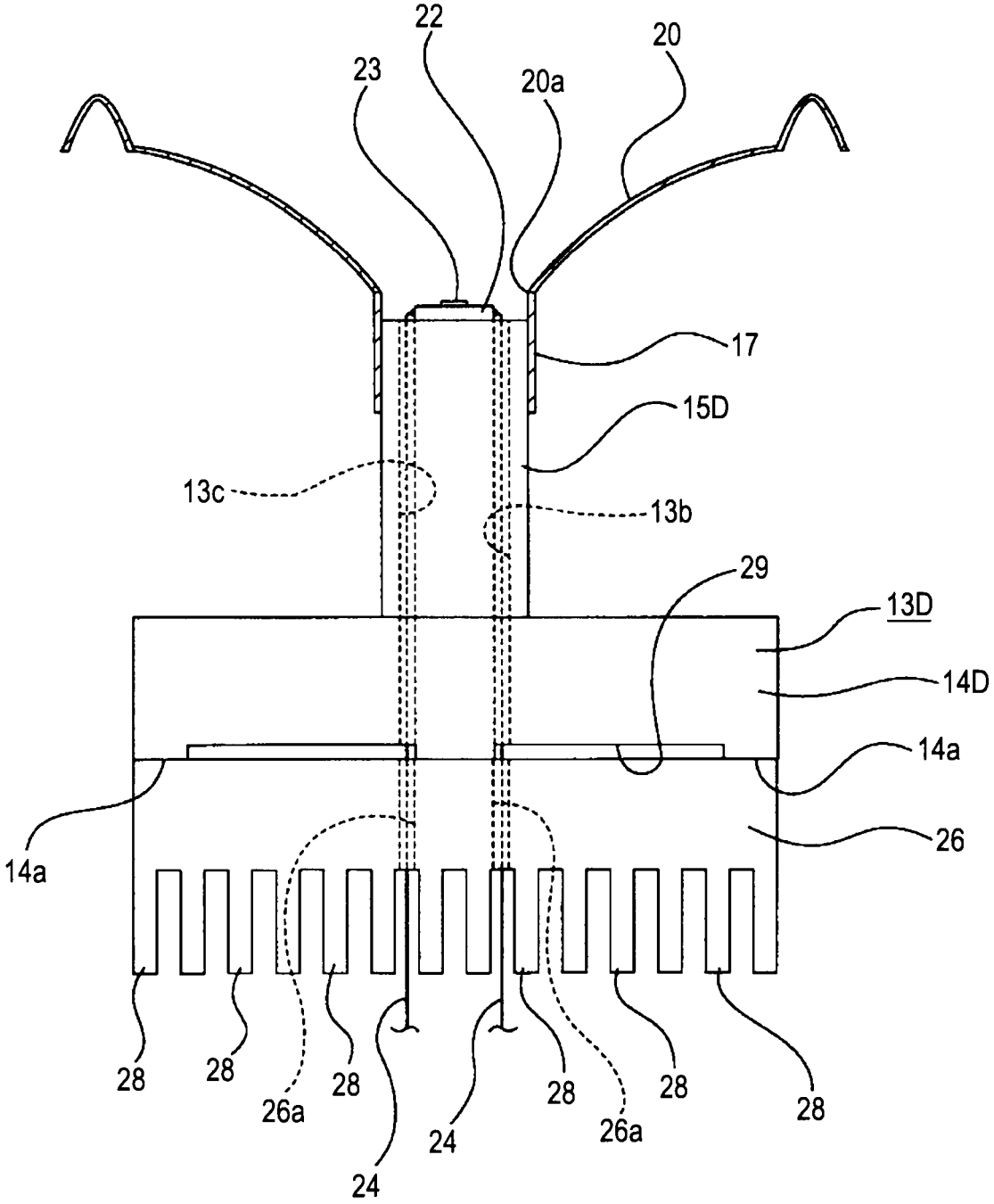
FIG. 10 is a side sectional view of the heat radiating structure according to the fourth modification of the embodiment.
Figure 11:
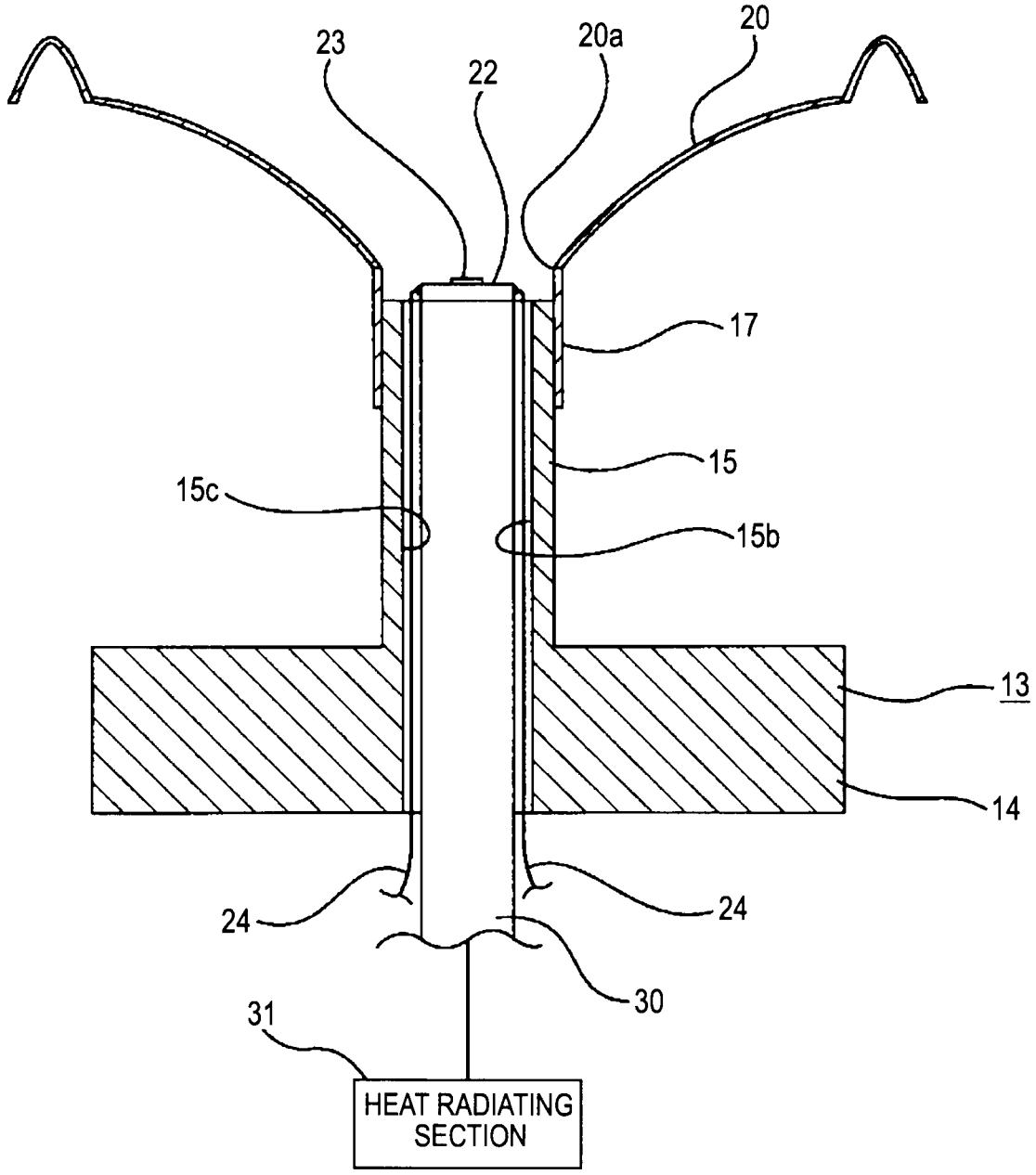
FIG. 11 is a schematic sectional view of an exemplary heat radiating structure in which a heat pipe is used as a heat controlling member.

A heat radiating structure according to a fourth modification of the embodiment will now be described (see FIGS. 9 and 10). The heat radiating structure according to the fourth modification includes a yoke 13D and a heat sink 25D.

The yoke 13D is attached to a rear surface of a magnet 12. The yoke 13D has a substantially disk-shaped base plane portion 14D and an inserted portion 15D projecting frontward from a central part of the base plane portion 14D, those portions being formed integrally with each other.

The yoke 13D is formed with a shaft accommodating hole 13*b* penetrating through central parts of the inserted portion 15D and the base plane portion 14D in the front-rear direction of the apparatus. Downward projections 14*a* are provided on the base plane portion 14D of the yoke 13D, the projections 14*a* being spaced in the circumferential direction of the base plane portion 14D. The projections 14*a* are formed with respective downwardly facing threaded holes 14*b*.

A heat sink 25D formed from a material having high thermal conductivity is attached to a rear surface of the yoke 13D. The heat sink 25D has a substantially disk-shaped base portion 26D, an inserted shaft portion 27 projecting frontward from a central part of the base portion 26D, and a plurality of heat radiating fins 28 projecting rearward from the inserted shaft portion 27, those portions being formed integrally with each other. The base portion 26D is formed with screw insertion holes 26*a* which are circumferentially spaced at an outer circumferential part of the base portion 26D and which penetrate through the base portion 26D in the front-rear direction of the apparatus.

The inserted shaft portion 27 of the heat sink 25D has a diameter smaller than the diameter of the shaft accommodating hole 13*b*. A front surface of the base portion 26D of the heat sink 25D is in contact with a rear surface of the projections 14*a* on the base plane portion 14D. For example, screw members 200 are inserted through the screw insertion holes 26*b* respectively and engaged with the threaded holes 14*b*. Thus, the base portion 26D is attached to the yoke 13D, and the inserted shaft portion 27 is inserted into the shaft accommodating hole 13*b* from rear side thereof.

When the inserted shaft portion 27 is inserted in the shaft accommodating hole 13*b*, a communicating space 29 is formed between the base plane portion 14D of the yoke 13D and the base portion 26D of the heat sink 25D, and the communicating space 29 is in communication with a cord accommodating space 13*c* and the atmosphere.

A substrate 22 is attached to a front surface of the inserted shaft portion 27 of the heat sink 25D.

Connection cords 24 for energizing a light emitting member 23 are connected to the substrate 22, and the connection cords 24 are laid through the cord accommodating space 13*c* and the communicating space 29 and connected to a power supply circuit on the circuit substrate which is disposed in a housing 2.

Heat generated when the light emitting member 23 emits light is conducted from the inserted shaft portion 27 and the base portion 26D of the heat sink 25D to the heat radiating fins 28 and radiated from the heat radiating fins 28.

Therefore, the heat sink 25D serves as a heat radiating section or a heat controlling member for radiating heat generated when the light emitting member 23 emits light.

Since heat generated when the light emitting member 23 emits light is radiated using the heat sink 25D as described above, improved sound quality can be achieved while maintaining a high level of heat radiation.

The cord accommodating space 13*c* and the communicating space 29 for accommodating the connection cords 24 are formed in the yoke 13D and the heat sink 25D, respectively. It is therefore not necessary to provide dedicated spaces for accommodating the connection cords 24 outside the magnetic circuit, and the speaker apparatus 1 can be provided in a small size as a result of improved space utilization.

Further, heat generated when the light emitting member 23 emits light is conducted from the inserted shaft portion 27 of the heat sink 25D to the base portion 26D. At this time, although the base portion 260 is in contact with the projections 14*a* of the base plane portion 14D of the yoke 13D, the front surface of the base portion 26D is not entirely in contact with the base plane portion 14D. Thus, the area over which the heat sink 25D contacts the yoke 13D can be kept small.

Only a small part of the heat conducted from the inserted shaft portion 27 to the base portion 26D is conducted to the yoke 13D, and the amount of heat radiated by the yoke 13D is small. It is therefore possible to suppress the influence of heat on the speaker apparatus 1.

Furthermore, since the heat sink 25D is provided with the heat radiating fins 28, a great radiating area can be obtained to keep a high level of heat radiation.

In the above-described example, the heat sink 25D and the yoke 13D are combined using the screw members 200. The present disclosure is not limited to the use of screws for combining the heat sink 25D and the yoke 13D, and other appropriate measures such as bonding and welding may be taken.

[Other Modifications]

In the above-described examples, the yokes 13 and 13A and the heat sinks 25, 25C, and 25D which are heat radiating sections are used as heat controlling members. A heat pipe 30 transmitting heat to a heat radiating section may be used as a heat controlling member (see FIG. 11).

A front end of the heat pipe 30 is connected to the circuit substrate 22 using a thermal grease or a high thermal conductivity adhesive, and a rear end of the heat pipe 30 is connected to a heat radiating section 31.

For example, a part of the housing 2 may be used as the heat radiating member 31, the part of the housing being a metal material and having high heat radiating properties.

When the heat pipe 30 is used as a heat controlling member as thus described, high sound quality can be achieved while maintaining a high level of heat radiation.

Since the use of the heat pipe 30 allows heat to be conducted to a desired position, the speaker apparatus 1 can be designed with a high degree of freedom while achieving a high level of heat radiation.

The specific shapes and structures of various parts of the above-described embodiments are all merely examples of specific modes of implementation of the present disclosure. Such examples should not be taken as limiting the technical scope of the present disclosure.

The present disclosure contains subject matter related to that disclosed in Japanese Priority Patent Application JP 2011-049027 filed in the Japan Patent Office on Mar. 7, 2011, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A speaker apparatus comprising:

a diaphragm vibrating to output sounds and being formed in an annular shape having a center hole in the middle thereof;

a driving section causing the diaphragm to vibrate;

a damper to dampen a movement that causes the diaphragm to vibrate;

a light emitting member emitting light; and a heat controlling member radiating heat generated when the light emitting member emits light or conducting the heat to a heat radiating section, wherein at least a part of the heat controlling member is provided on an axis including a center axis of the diaphragm, and the light emitting member is disposed on an end face of the heat controlling member, and along the axis the light emitting member is disposed between the damper and an end of the diaphragm closest to the damper.

2. The speaker apparatus according to claim 1, further comprising a heat radiating section radiating heat provided as the heat controlling member, wherein a part of the driving section is used as the heat radiating section.

3. The speaker apparatus according to claim 1, wherein a space is formed on an outer circumferential side of the part of the heat controlling member provided on an axis including the center axis of the diaphragm, and the space is used as a bass reflex port to enhance low pitched sounds.

4. The speaker apparatus according to claim 3, further comprising a connection cord to energize the light emitting member, wherein the connection cord is disposed in the bass reflex port.

5. The speaker apparatus according to claim 1, wherein a heat sink is used as the heat controlling member.

6. The speaker apparatus according to claim 5, wherein a plurality of heat radiating fins are provided on the heat sink.

7. The speaker apparatus according to claim 1, further comprising a heat pipe to conduct heat to the heat radiating section, provided as the heat controlling member.

8. The speaker apparatus according to claim 1, further comprising a center cap having light transmitting or light diffusing properties disposed to cover the light emitting member.

9. The speaker apparatus according to claim 1, further comprising a housing that houses the diaphragm, the driving section, the damper, the light emitting member, and the heat controlling member, and at least a part of the housing is the heat radiating section.

10. The speaker apparatus according to claim 1, further comprising a movable bobbin fitted around the heat controlling member, wherein the diaphragm is attached to an end of the movable bobbin, and the damper is attached to the movable bobbin.

11. The speaker apparatus according to claim 1, wherein the light emitting member is a light emitting diode or an organic electro-luminescence element.

12. A speaker apparatus comprising:

a diaphragm vibrating to output sounds and being formed in an annular shape having a center hole in the middle thereof;

a bobbin including a voice coil wound around the bobbin, and the bobbin is movable to vibrate the diaphragm;

a damper attached to the bobbin to dampen a movement of the bobbin;

a light source to emit light; and a conductor to radiate heat generated when the light source emits light or to conduct the heat to a heat radiator, wherein at least a part of the conductor is provided on an axis including a center axis of the diaphragm, and the light source is disposed on an end face of the heat controlling member, and along the axis the light source is disposed between the damper and an end of the diaphragm closest to the damper.

* * * * *